US011529639B2

(12) United States Patent
Klingler et al.

(10) Patent No.: US 11,529,639 B2
(45) Date of Patent: Dec. 20, 2022

(54) ALIGNMENT DEVICE AND METHOD FOR ALIGNING A SHOWER BAR NOZZLE FLANGE

(71) Applicant: VALMET AB, Sundsvall (SE)

(72) Inventors: James Michael Klingler, Jaffrey, NH (US); Frank John Merchel, III, Windham, NH (US)

(73) Assignee: VALMET AB, Sundsvall (SE)

( * ) Notice: Subject to any disclaimer, the term of this patent is extended or adjusted under 35 U.S.C. 154(b) by 128 days.

(21) Appl. No.: 16/887,060

(22) Filed: May 29, 2020

(65) Prior Publication Data

US 2021/0370324 A1 Dec. 2, 2021

(51) Int. Cl.

| | |
|---|---|
| ***B05B 1/20*** | (2006.01) |
| ***B05B 12/16*** | (2018.01) |
| *D21D 1/40* | (2006.01) |

(52) U.S. Cl.

CPC ..... *B05B 1/205* (2013.01); *B05B 12/16* (2018.02); *D21D 1/40* (2013.01)

(58) Field of Classification Search

None

See application file for complete search history.

(56) References Cited

U.S. PATENT DOCUMENTS

| | | | | |
|---|---|---|---|---|
| 4,511,088 | A | 4/1985 | Wilt et al. | |
| 4,795,558 | A | 1/1989 | LaValley | |
| 5,028,007 | A | 7/1991 | Wokal | |
| 8,959,790 | B2 * | 2/2015 | Anerud | F16L 3/00 162/359.1 |
| 2002/0179745 | A1 | 12/2002 | Dolan et al. | |
| 2007/0163630 | A1 | 7/2007 | Grace et al. | |
| 2014/0318448 | A1 * | 10/2014 | Hug | D06B 1/02 118/325 |
| 2015/0034733 | A1 | 2/2015 | Grace | |
| 2018/0009619 | A1 * | 1/2018 | Perini | B65H 19/283 |

OTHER PUBLICATIONS

International Search Report and Written Opinion, PCT/SE2021/050425, dated Jul. 1, 2021, 11 pages.

* cited by examiner

*Primary Examiner* — Jethro M. Pence

(74) *Attorney, Agent, or Firm* — Foley & Lardner LLP

(57) ABSTRACT

Alignment device (1) for adjusting a position of a curved shower bar nozzle flange (2) relative a permeable outer cylindrical surface (3) of a drum roll (4) of for instance a drum washer. The alignment device comprises a body element (8), an attachment device (9) and a contact element (11). The body element has a length adapted to a desired predetermined distance between the end (7) of the nozzle flange and the outer cylindrical surface (3). The attachment device (9) is arranged at a first end (10) of the body element (8) for releasably connecting the body element to the nozzle flange end (7) to extend tangentially therefrom. The contact element (11) is arranged at a second opposite end (12) of the body element, said contact element being adapted to abut against said permeable outer cylindrical surface (3). A method for aligning a nozzle flange using such an alignment device is also provided.

14 Claims, 3 Drawing Sheets

ALIGNMENT DEVICE AND METHOD FOR ALIGNING A SHOWER BAR NOZZLE FLANGE

TECHNICAL FIELD

The invention relates to the field of shower bar nozzle flanges used for instance in a drum washer for washing pulp. More particularly, the invention relates to an alignment device and a method for aligning such a shower bar nozzle flange relative a permeable outer surface of a drum roll.

BACKGROUND

During production of pulp, the pulp is usually washed at least once to remove chemicals from preceding process steps from the pulp. Such washing may be performed using a drum washer where a pulp mat formed on a permeable outer surface of the drum is washed by spraying or otherwise distributing wash liquid thereon.

A type of device for spraying wash liquid is known as shower bars or pipes being elongated and extending along the outer surface of the drum. Such shower bars are provided with nozzles through which wash liquid flows out from the interior of the shower bar towards the drum.

U.S. Pat. No. 5,028,007 discloses such a shower bar/pipe where each nozzle is furthermore provided with a diffusion flange having a parabolically curved diffusion/guiding surface to distribute the wash liquid flow laterally and also to guide the flow at a suitable angle towards the drum surface.

The flange is advantageously set with its end tangentially to the drum surface so that the water flow runs as a uniform stream flooding the pulp mat. Typically, the end is to be set tangentially at 12-14 inches from the permeable outer surface of the drum. This is however not easily done since the flange is curved and achieving a proper tangential alignment with the end thereof is often difficult. At present, no standardized and accurate alignment device or method is available.

SUMMARY

An object of the invention is to provide an accurate and convenient alignment device and method for aligning the shower bar nozzle flange with the drum surface in the manner described in the background section above.

These and other objects are achieved by the present invention by means of an alignment device, a method and a system according to the independent claims.

According to a first aspect of the invention, there is provided an alignment device for adjusting a position of a shower bar nozzle flange relative a permeable outer cylindrical surface of a drum roll of for instance a drum washer. The nozzle flange is at least partly curved, preferably parabolically curved, and is adapted to extend from a nozzle outlet in the shower bar to a flange end, the flange end being adapted to be tangentially aligned with said outer cylindrical surface. The alignment device comprises a body element, an attachment device and a contact element. The body element has a length adapted to a desired predetermined distance between the nozzle flange end and the outer cylindrical surface. The attachment device is arranged at a first end of the body element for releasably connecting the body element to the nozzle flange end to extend tangentially therefrom. The contact element is arranged at a second opposite end of the body element or forming a portion thereof, said contact element being adapted to abut against said permeable outer cylindrical surface.

It is understood that the nozzle flange is at least partly curved in the sense that it comprises at least one curved portion. Normally, the nozzle flange is curved all the way from the start at the nozzle in the shower bar down to a plane portion at the nozzle flange end being for instance 0.5 inches long. Thus, it is normally this plane portion which is to be tangentially aligned with the outer cylindrical surface. It is furthermore understood that the body element does not necessarily need to have a length which is exactly equal to the desired predetermined distance between the nozzle flange end and the outer cylindrical surface, but may be shorter or longer depending on the shape of the attachment device and the contact element. For instance, the attachment device may be partly formed by a portion of the body element. Furthermore, the contact element does not necessarily need to be placed to make contact with the outer cylindrical surface at a position which corresponds exactly to the second end of the body element. It is furthermore understood that any reference to a longitudinal direction of the alignment device, the body element, or parts thereof, herein refers to the direction defined from the first end to the second end of the body element, which direction corresponds to the tangential direction when used for aligning a nozzle flange.

In embodiments, the body element and/or the alignment device as a whole may have a tapered shape, tapering from the first end towards the second end. The body element may have a width at its first end adapted to the width of the nozzle flange end. A first end of the body element may have or comprise a straight edge adapted to make contact, preferably along its full length, with a nozzle flange end having a straight free end edge.

In embodiments, the attachment device comprises a clamping device having at least one clamping element arranged to provide a clamping force, or act clampingly, against the nozzle flange by means of at least one tensioning device such as a spring, screw, bolt, thumb screw, toggle clamp mechanism, cam mechanism, ratchet clamp mechanism or the like. The clamping element may be a clamping bar which is pivotably or slidingly connected to the body element in a direct or indirect manner. The at least one clamping element or bar may be displaceable towards the body element by means of the tensioning device such that the nozzle flange is clamped between the body element and the at least one clamping element. In such an embodiment, the body element acts a clamping bar. Alternatively, two or more clamping elements or bars may be provided arranged to clamp the nozzle flange therebetween, i.e. corresponding to a clamp being attached to the body element.

In an alternative embodiment, the attachment device comprises a groove or slot in or at the first end of the body element, the groove having a width adapted to the thickness of the nozzle flange end. The groove has a depth of for example 0.5 inches. The depth is preferably adapted to the length of the plane portion of the nozzle flange end to provide the largest possible area of contact between the nozzle flange and the alignment device.

In embodiments, the body element comprises a substantially plane body portion adapted to form a tangential extension of the nozzle flange end when connected thereto. In other words, the body element comprises a plane portion, but does not necessarily need to be plane as a whole. The body element may for instance be provided with strengthening elements (such as ribs or bent portions) along the length of the alignment device. In embodiments where the nozzle flange comprises a plane portion at the nozzle flange end, the substantially plane body portion extends in parallel with the plane portion.

In embodiments where the body element comprises a substantially plane body portion, the contact element may be protruding downwardly from a plane defined by the substantially plane body portion and may have a pointed or curved edge adapted to abut against the permeable outer cylindrical surface. Such a downwardly protruding contact element may be advantageous since it provides a well-defined point or line of contact with the outer cylindrical surface.

In embodiments, the contact element is provided as a downwardly protruding portion of the body element, for instance in the form of a V-shaped or U-shaped stamping in the body element. The downwardly protruding portion may extend from the attachment device or first end of the body element to the second end of the body element. Such a downwardly protruding portion may be advantageous since it also provides a reinforcing effect on the body element.

In embodiments, the body element comprises an end portion being curved upwardly relative the body portion around an axis being substantially perpendicular with a longitudinal direction of the body portion. In other words, the end portion is curved in an opposite direction relative the contact element, i.e. in a direction away from the outer cylindrical surface of the drum roll. This may be advantageous since it protects the outer cylindrical surface during alignment work. This surface is normally formed as a face wire mesh, which may be damaged by an alignment device having a sharp end.

The two embodiments described above are advantageously combined to form an embodiment having a body element with an end portion being curved upwardly relative the (plane) body portion, and a contact element formed as a downwardly protruding portion. The downwardly protruding portion may be a stamping in the body element, or more specifically in the plane body portion, which may extend from the attachment device or first end of the body element to the second end of the body element (including or not including the curved end portion). The intended point of contact between the contact element and the outer cylindrical surface is advantageously before the curved end portion (as seen from the nozzle flange), such that the curved end portion merely serves to protect the outer cylindrical surface. It is however foreseeable that the point of contact is at the curved end portion.

In embodiments, the point or line of the contact element intended to make contact with the outer cylindrical surface is colour-marked.

In embodiments, the contact element is arranged at the second opposite end of the body element and forms a right angle therewith, the contact element comprising a curved edge for instance by having a disc shape formed integrally with, or connected to, the body element. The contact element may be an end portion of the body element which has been twisted to form a right angle with the rest of the body element (or with the plane body portion). The contact element may be round or disc-shaped and may have a diameter of about 1 inch, such that about 0.5 inches of the contact element protrudes downwardly relative the body element or plane body portion. These embodiments are advantageous since the contact element is readily visible and can conveniently and accurately be put into contact with the outer cylindrical surface.

According to a second aspect of the invention, there is provided a shower bar nozzle flange system comprising at least one shower bar nozzle flange, each nozzle flange being at least partly curved, preferably parabolically curved, and being adapted to extend from a nozzle outlet in the shower bar to a flange end, said flange end being adapted to be tangentially aligned with a permeable outer cylindrical surface of a drum roll of for instance a drum washer at a predetermined distance therefrom, said system further comprising an alignment device according to the first aspect of the invention or embodiments thereof.

In embodiments, the system furthermore comprises an elongated hollow shower bar having at least one nozzle outlet, wherein each nozzle flange is connected to the shower bar at a corresponding nozzle outlet. The elongated hollow shower bar has a cross-section which may for instance be square or round.

According to a third aspect of the invention, there is provided a method for aligning a shower bar nozzle flange relative a permeable outer cylindrical surface of a drum roll of for instance a drum washer using an alignment tool according to the first aspect of the invention or embodiments thereof, the nozzle flange being at least partly curved, preferably parabolically curved, and being adapted to extend from a nozzle outlet in the shower bar to a flange end, the flange end being adapted to be tangentially aligned with said outer cylindrical surface at a predetermined distance therefrom. The method comprises attaching the alignment device to the nozzle flange end using the attachment device and adjusting the position of the nozzle flange such that the contact element makes contact with said outer cylindrical surface.

The features of the embodiments described above are combinable in any practically realizable way to form embodiments having combinations of these features. Further, all features and advantages of embodiments described above with reference to the first aspect of the invention may be applied in corresponding embodiments of the second and third aspects of the invention.

BRIEF DESCRIPTION OF THE DRAWINGS

Above discussed and other aspects of the present invention will now be described in more detail using the appended drawings, which show presently preferred embodiments of the invention, wherein:

FIGS. 2 and 4-6 also illustrate different embodiments of a system according to the second aspect of the invention.

DETAILED DESCRIPTION

Figure 1:
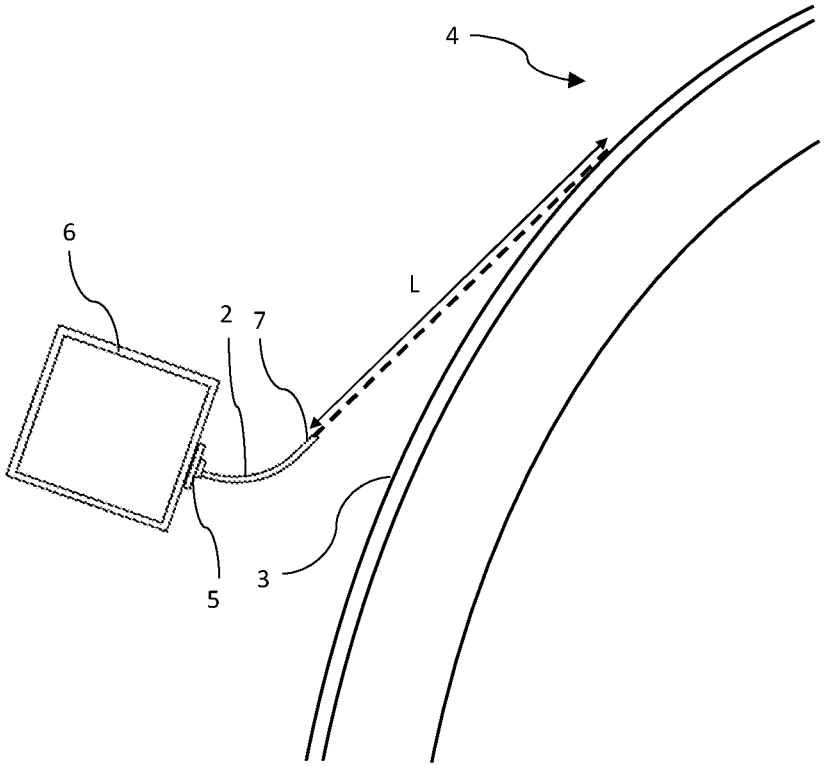
FIG. 1 shows a cross section view of a shower bar provided with a nozzle flange having its flange end tangentially aligned with an outer surface of a drum washer roll.

FIG. 1 shows a cross section view of an elongated hollow shower bar 6 having nozzle outlets (where only one nozzle outlet 5 is visible in the shown cross-section. A shower bar nozzle flange 2 is attached to the nozzle outlet 5, which nozzle flange is partly parabolically curved in the sense that it comprises a curved portion extending from the nozzle outlet 5 in the shower bar to a plane portion at the nozzle flange end 7 being about 0.5 inches long. The nozzle flange is to be aligned tangentially with the outer cylindrical surface 3 of the drum 4 so that the water flow runs as a uniform stream flooding the pulp mat. The flange is tangentially aligned in the sense that the plane portion at the flange end 7 is tangentially aligned with the outer cylindrical surface 3 as indicated by the dotted line in FIG. 1. The outer cylindrical surface 3 is permeable (normally formed as a face wire mesh) such that liquid can penetrate through a pulp mat disposed on the permeable surface 3 and be drawn in through the permeable surface by means of vacuum in the interior of the drum 4. In order to achieve optimum performance, the manufacturer of the nozzle flange typically specifies a predetermined optimum distance between the nozzle flange end and the outer cylindrical surface. This predetermined distance is typically 12-14 inches and is indicated by L in FIG. 1.

Figure 2:
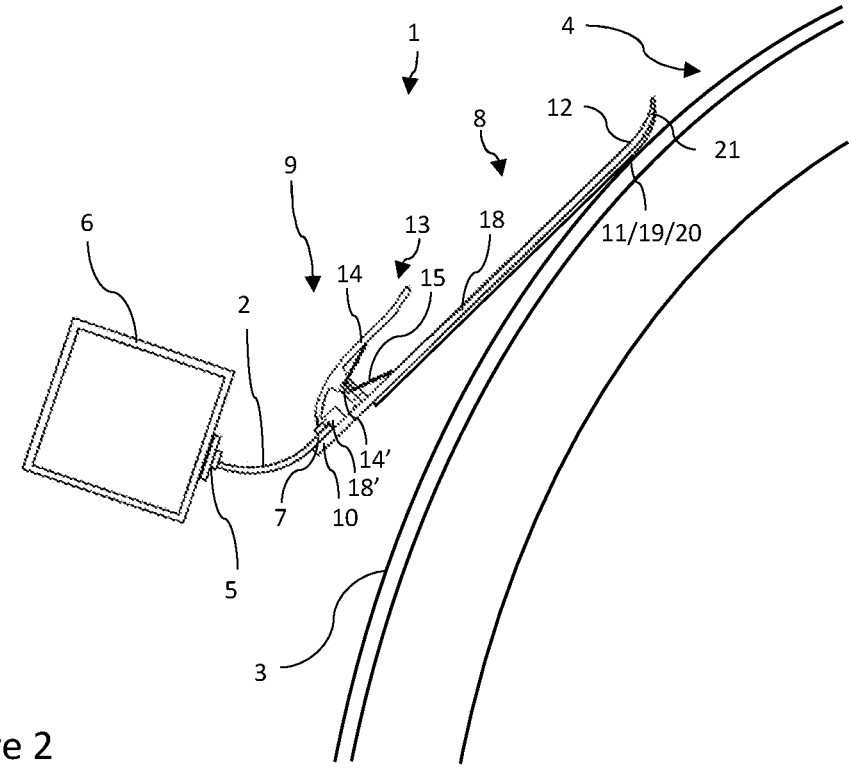
FIG. 2 shows a cross section view of a first embodiment of an alignment device according to the first aspect of the invention when used to align a nozzle flange end tangentially relative an outer surface as shown in FIG. 1.

FIG. 2 shows a cross section view of a first embodiment of an alignment device according to the first aspect of the invention when used to align a nozzle flange end tangentially relative an outer surface as shown in FIG. 1. FIG. 2 also illustrate a first embodiment of a system according to the second aspect of the invention. The alignment device 1 comprises a body element 8, an attachment device 9 and a contact element 11. The body element 8 has a length adapted to the above mentioned desired predetermined distance L between the nozzle flange end 7 and the outer cylindrical surface 3. The attachment device 9 is arranged at a first end 10 of the body element for releasably connecting the body element to the nozzle flange end to extend tangentially therefrom. The contact element is arranged at a second opposite end 12 of the body element forming a portion thereof. The contact element 11 abuts against the outer cylindrical surface 3.

The attachment device 9 comprises a clamping device 13 having a clamping bar 14 arranged to act clampingly against the above-mentioned plane portion of the nozzle flange (at its end 7) by means of a spring 15. The clamping bar 14 is pivotably connected to the body element 8 around a pivot axis 14'. The body element comprises a substantially plane body portion 18 which forms a tangential extension of the nozzle flange end in the sense that it is parallel with the plane portion at the nozzle flange end 7. The body portion 18 extends in the lengthwise direction beneath the clamping bar 14 past the pivot axis 14' such that the plane portion of the nozzle flange (at its end 7) is clamped between the body portion 18 and the clamping bar 14. The attachment device is furthermore provided with a straight guiding rib 18' being attached to the body portion 18 and extending in a transverse direction of the alignment device. The nozzle flange end 7 is positioned in abutment with the guiding rib 18' acting as a stop to make sure that the body portion 18 is in abutment with the plane portion of the nozzle flange to align tangentially therewith.

The contact element 11 is provided as a downwardly protruding portion 20 of the body element in the form of a V-shaped stamping in the body portion 18, which forms a pointed edge 19. The body element 8 comprises an end portion 21 which is curved upwardly relative the body portion 18 (i.e. in a direction away from the outer cylindrical surface of the drum roll) around an axis being substantially perpendicular with a longitudinal direction of the body portion. The stamping 20 extends from the attachment device 9 to the second end 12 of the body element (including the curved end portion 21). The intended point or line of contact (at ref. 11/19/20 in FIG. 2) between the edge 19 of the stamping 20 and the outer cylindrical surface 3 is before the curved end portion (as seen from the nozzle flange). In other embodiments, the stamping 20 is shorter, and may only extend in the vicinity of the intended point or line of contact. In yet other embodiments, the stamping 20 is instead longer than in FIG. 2 and may extend all the way to the first end 10.

Figure 3:
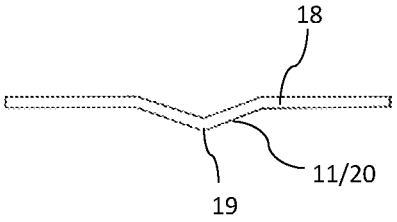
FIG. 3 shows a cross section view of the alignment device in FIG. 2.

FIG. 3 shows a cross section view of the alignment device in FIG. 2 taken at ref. 11/19/20 in FIG. 2. FIG. 3 illustrates the contact element 11 in the form of a stamping 20 in the plane body portion 18 forming the edge 19 for contact with the outer cylindrical surface 3.

Figure 4:
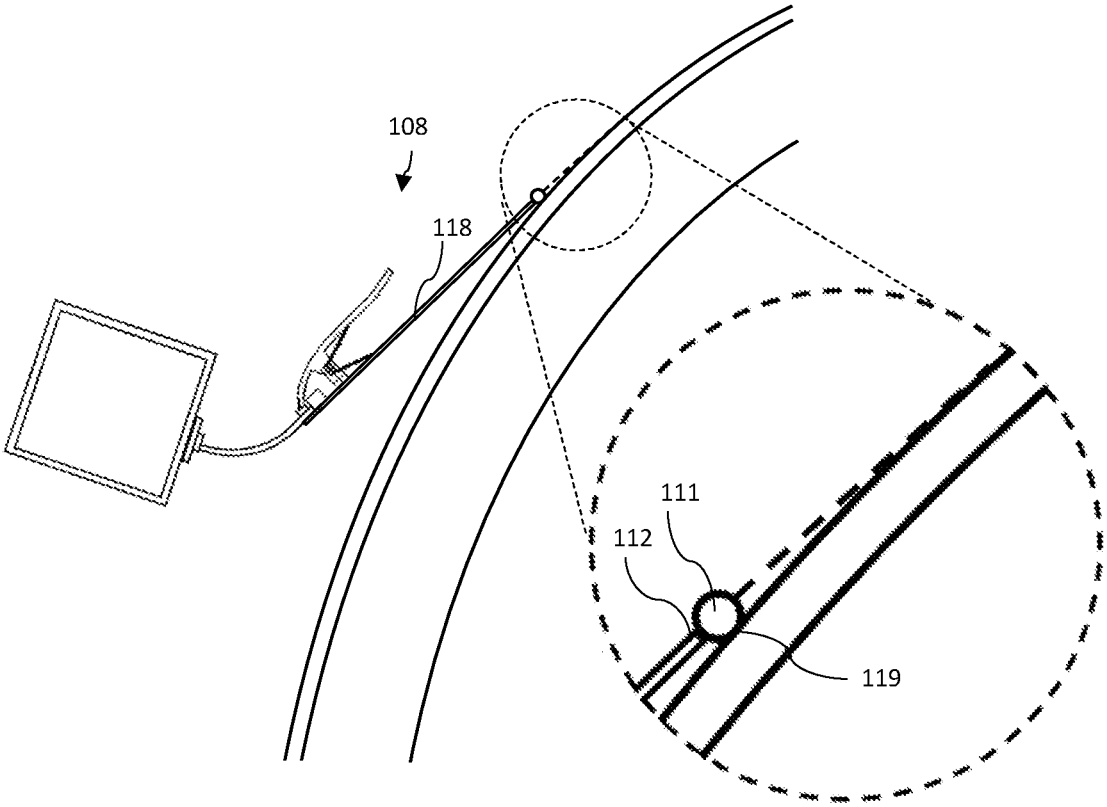
FIG. 4 shows a cross section view of a second embodiment of an alignment device according to the first aspect of the invention when used to align a nozzle flange end tangentially relative an outer surface as shown in FIG. 1.

FIG. 4 shows a cross section view of a second embodiment of an alignment device according to the first aspect of the invention when used to align a nozzle flange end tangentially relative an outer surface as shown in FIG. 1. FIG. 4 also illustrate a second embodiment of a system according to the second aspect of the invention. The second embodiments only differ from the first embodiments in that the contact element and the second end of the body element are different. In the second embodiments, the contact element 111 is provided arranged at the second opposite end 112 of the body element 8 forming a right angle with the body portion. The contact element 111 has a disc shape and the curved edge 119 is formed as the downwardly protruding portion thereof. Since the edge 119 protrudes longer downwardly than the stamping 20 in FIG. 2, the body element 108 is shorter than the body element 8 in FIG. 2, such that the body element aligns tangentially with the outer cylindrical surface of the drum (see the dotted line in FIG. 4). Furthermore, since a rounded shape is provided by disc 111, there is no need for a curved end portion 20 as in FIG. 2. The disc shaped contact element 111 disposed at right angle relative the body portion may be formed integrally therewith by means of twisting the body portion around a longitudinal axis. Apart from the differences identified above, the description with reference to FIG. 2 also applies to the second embodiments.

Figure 5:
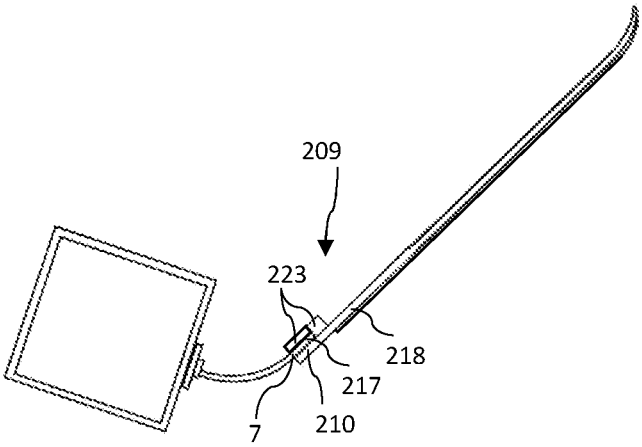
FIG. 5 shows a cross section view of a third embodiment of an alignment device according to the first aspect of the invention.

FIG. 5 shows a cross section view of a third embodiment of an alignment device according to the first aspect of the invention. FIG. 5 also illustrate a third embodiment of a system according to the second aspect of the invention. The third embodiments only differ from the first embodiments in that the first end of the alignment device is configured differently with an attachment device 209 in the form of a groove/slot 217 adapted to receive the nozzle flange end 7 rather than the clamping device in FIG. 1. The attachment device comprises a groove or slot 217 at the first end 210 of the body element, the groove having a width adapted to the thickness of the nozzle flange end 7. The groove has a depth of for example 0.5 inches. The depth is adapted to the length of the plane portion of the nozzle flange. The groove/slot 217 is formed by means of an L-shaped element 223 attached to the plane body portion 218 of the body element. Apart from the differences identified above, the description with reference to FIG. 2 also applies to the third embodiments. In other embodiments, the groove is formed in the body element, or is formed as a separate component which is attached to the body element.

Figure 6:
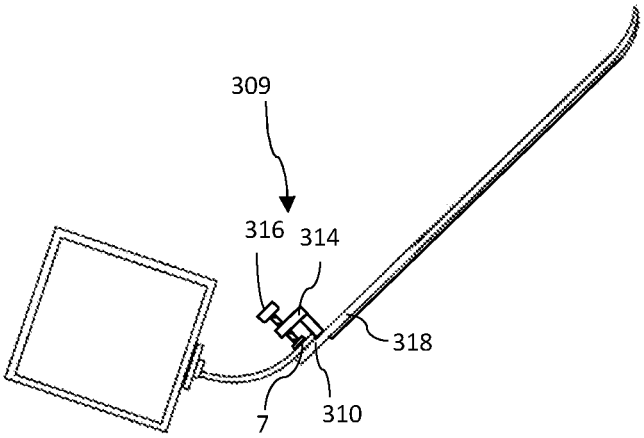
FIG. 6 shows a cross section view of a fourth embodiment of an alignment device according to the first aspect of the invention.

FIG. 6 shows a cross section view of a fourth embodiment of an alignment device according to the first aspect of the invention. FIG. 6 also illustrate a fourth embodiment of a system according to the second aspect of the invention. The third embodiments only differ from the first embodiments in that the attachment device at the first end 310 of the alignment device is different. Rather than having a spring clamping device as in FIG. 2, the fourth embodiment comprises a screw clamp 309 which could also be referred to as a C-clamp. In a corresponding manner as in the first embodiment (FIG. 2), the plane portion of the nozzle flange (at its end 7) is clamped between the body portion 318 and the clamping element being the free/lower end of a screw 316 which is disposed in a threaded hole in clamping bar 314. Apart from the differences identified above, the description with reference to FIG. 2 also applies to the fourth embodiments.

Figure 7:
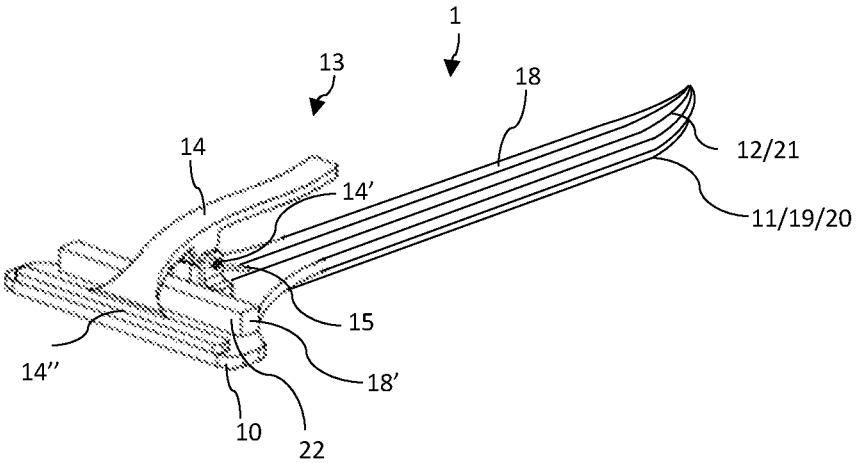
FIG. 7 shows a perspective view of the alignment device in FIG. 2.

FIG. 7 shows a perspective view of the alignment device in FIG. 2. In FIG. 7, the straight guiding rib 18' attached to the body portion 118 can be more clearly seen. The guiding rib 18' is provided with a straight edge 22 adapted to make contact along its full length with a nozzle flange end having a straight free end edge. Further, a transversely extending clamping rib 14" is shown, which is part of the clamping bar 14 and has a length adapted to the width of the body portion/element at the first end 10, which width further is adapted to the width of the nozzle flange end. When attached to a nozzle flange, the plane portion of the nozzle flange (at its end 7, see FIG. 2) is clamped between the clamping rib 14" and body portion 18. As can further been seen in FIG. 7, the body element has a tapered shape, tapering from the first end 10 towards the second end 12 and the upwardly curved portion 21. FIG. 7 also shows the contact element 11 in the form of a V-shaped stamping 20 in the body portion 18 and in the upwardly curved end portion 21, including the pointed edge 19 of the stamping. The stamping 20 can been seen protruding downwardly from the body portion/end portion, and also as a recess in the upper surface of the body portion/end portion. As shown in FIG. 7, the lower end of spring 15 rests in the recess formed by the stamping 20 to prevent the lower end from slipping sideways/laterally.

Figure 8:
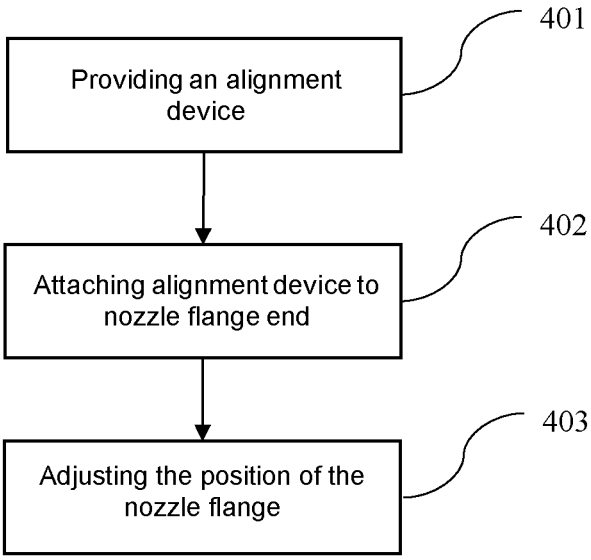
FIG. 8 shows a flow chart illustrating an embodiment of a method according to the third aspect of the invention.

FIG. 8 shows a flow chart illustrating an embodiment of a method according to the third aspect of the invention. The method concerns aligning a shower bar nozzle flange relative a permeable outer cylindrical surface of a drum roll of for instance a drum washer, the nozzle flange being at least partly curved, preferably parabolically curved, and being adapted to extend from a nozzle outlet in the shower bar to a flange end, the flange end being adapted to be tangentially aligned with the outer cylindrical surface at a predetermined distance therefrom. The method comprises providing 401 an alignment device according to the first aspect of the invention, attaching 402 the alignment device to the nozzle flange end using the attachment device, and adjusting 403 the position of the nozzle flange such that the contact element makes contact with said outer cylindrical surface.

The description above and the appended drawings are to be considered as non-limiting examples of the invention. The person skilled in the art realizes that several changes and modifications may be made within the scope of the invention. For example, other attachment devices than the above described spring clamp and screw clamps are possible, as long as an attaching functionality enabling the alignment device to extend tangentially is achieved. Furthermore, other contact elements than the above described downwards protrusions in the form of a stamping or disc are foreseeable, as long as a well-defined point or line of contact with the cylindrical outer surface is achieved. Furthermore, the body element does not have to comprise a plane body portion, but can have any shape or cross-section as long as it can support the attachment device in its first end and the contact element at its second end. Furthermore, the elongated hollow shower bar 6 does not necessarily need to have a square cross-section as in the embodiments described above but may alternatively have a round cross-section.

The invention claimed is:

1. An alignment device for adjusting a position of a shower bar nozzle flange relative to a permeable outer cylindrical surface of a drum roll of a drum washer, the shower bar nozzle flange being at least partly curved, and the shower bar nozzle flange being configured to extend from a nozzle outlet in a shower bar to a nozzle flange end, said nozzle flange end being configured to be tangentially aligned with the permeable outer cylindrical surface, the alignment device comprising:

a body having a length corresponding to a desired predetermined distance between the nozzle flange end and the permeable outer cylindrical surface;

an attacher arranged at a first end of the body for releasably connecting the body to the nozzle flange end to extend tangentially therefrom; and a contact element arranged at a second opposite end of the body, or forming a portion of the second opposite end of the body, the contact element being arranged to abut against the permeable outer cylindrical surface.

2. The alignment device according to claim 1, wherein the attacher comprises a clamping device having at least one clamp arranged to provide a clamping force against the nozzle flange end by means of at least one tensioner.

3. The alignment device according to claim 1, wherein the attacher comprises a groove or slot in or at the first end of the body, the groove or slot having a width adapted to a thickness of the nozzle flange end.

4. The alignment device according to claim 1, wherein the body comprises a plane body portion arranged to form a tangential extension of the nozzle flange end when connected thereto.

5. The alignment device according to claim 4, wherein the contact element protrudes downwardly from a plane defined by the plane body portion and has a pointed or curved edge configured to abut against the permeable outer cylindrical surface.

6. The alignment device according to claim 5, wherein the contact element is provided as a downwardly protruding portion of the body.

7. The alignment device according to claim 4, wherein the body comprises an end portion being curved upwardly relative to the portion of the body around an axis being perpendicular with a longitudinal direction of the portion of the body.

8. The alignment device according to claim 5, wherein the contact element is arranged at the second opposite end of the body and forms a right angle therewith, the contact element comprises the curved edge by having a disc shape formed integrally with, or connected to, the body.

9. The alignment device according to claim 1, wherein the body has a tapered shape, tapering from the first end towards the second opposite end.

10. The alignment device according to claim 9, wherein the body has a width at the first end adapted to a width of the nozzle flange end.

11. The alignment device according to claim 1, wherein the first end of the body has a straight edge arranged to make contact along a full length of the body with the nozzle flange end having a straight free end edge.

12. A shower bar nozzle flange system comprising a shower bar nozzle flange being at least partly curved, and being configured to extend from a nozzle outlet in a shower bar to a nozzle flange end, the nozzle flange end being configured to be tangentially aligned with a permeable outer cylindrical surface of a drum roll of a drum washer at a predetermined distance therefrom, the system further comprising the alignment device according to claim 1.

13. A method for aligning a shower bar nozzle flange relative to a permeable outer cylindrical surface of a drum roll of a drum washer using the alignment device according to claim 1, the shower bar nozzle flange being at least partly curved, and being configured to extend from a nozzle outlet in a shower bar to a nozzle flange end, the nozzle flange end being configured to be tangentially aligned with the permeable outer cylindrical surface at a predetermined distance therefrom, the method comprising: attaching the alignment device to the nozzle flange end using an attacher, and adjusting a position of the shower bar nozzle flange such that a contact element makes contact with the permeable outer cylindrical surface.

14. The alignment device according to claim 6, wherein the contact element is provided as a V-shaped or U-shaped stamping in the body.

* * * * *